US007300352B2

(12) United States Patent
Rowe

(10) Patent No.: US 7,300,352 B2
(45) Date of Patent: Nov. 27, 2007

(54) METHOD AND APPARATUS FOR GRAPHICALLY PORTRAYING GAMING ENVIRONMENT AND INFORMATION REGARDING COMPONENTS THEREOF

(75) Inventor: Rick Rowe, Henderson, NV (US)

(73) Assignee: IGT, Reno, NV (US)

( * ) Notice: Subject to any disclaimer, the term of this patent is extended or adjusted under 35 U.S.C. 154(b) by 561 days.

(21) Appl. No.: 10/259,998

(22) Filed: Sep. 26, 2002

(65) Prior Publication Data

US 2003/0109308 A1 Jun. 12, 2003

Related U.S. Application Data

(63) Continuation-in-part of application No. 09/965,785, filed on Sep. 27, 2001, now Pat. No. 6,884,170.

(51) Int. Cl.
*A63F 9/24* (2006.01)

(52) U.S. Cl. ..... 463/32; 463/25; 463/29; 463/30; 463/31

(58) Field of Classification Search ..... 705/1, 705/14; 463/42, 29, 32, 33, 25, 30, 31
See application file for complete search history.

(56) References Cited

U.S. PATENT DOCUMENTS 5,611,730 A * 3/1997 Weiss ..... 463/20
5,613,912 A * 3/1997 Slater ..... 463/25
5,762,552 A * 6/1998 Vuong et al. ..... 463/25
5,974,135 A * 10/1999 Breneman et al. ..... 379/265.04
6,117,011 A 9/2000 Lvov
6,234,900 B1 * 5/2001 Cumbers ..... 463/29
6,319,125 B1 * 11/2001 Acres ..... 463/25
6,383,077 B1 * 5/2002 Kweitko et al. ..... 463/40
6,409,602 B1 * 6/2002 Wiltshire et al. ..... 463/42

(Continued)

FOREIGN PATENT DOCUMENTS

EP 0 843 272 5/1998

(Continued)

OTHER PUBLICATIONS

Howington, U.S. Appl. No. 60/241,326, filed Oct. 18, 2000.*

(Continued)

*Primary Examiner*—Ronald Laneau
*Assistant Examiner*—Travis Banta
(74) *Attorney, Agent, or Firm*—Dean E. Wolf; Beyer Weaver LLP

(57) ABSTRACT

A method and apparatus for providing a graphical representation of a gaming environment and for providing information regarding individual components or persons located in the environment are provided. The invention includes a graphical user interface which displays a graphical representation of at least a portion of a gaming environment, such as a graphical representation of individual components of a gaming system and their surrounding physical environment. The components are graphically portrayed in positions corresponding to the relative positions of the actual components of the gaming system. The components are also graphically displayed in a graphically reproduced environment which represents the actual environment, such as a casino, in which the actual gaming system components are located. By selecting a graphically represented component, information regarding the actual gaming system component which is represented is provided, such as by display in a window associated with the graphical user interface.

54 Claims, 5 Drawing Sheets

U.S. PATENT DOCUMENTS

| | | | | |
|---|---|---|---|---|
| 6,460,848 | B1 * | 10/2002 | Soltys et al. | 273/149 R |
| 6,508,709 | B1 * | 1/2003 | Karmarkar | 463/42 |
| 6,629,003 | B1 * | 9/2003 | Frizzell et al. | 700/97 |
| 6,884,170 | B2 * | 4/2005 | Rowe | 463/31 |
| 6,887,157 | B2 * | 5/2005 | LeMay et al. | 463/32 |
| 2002/0087679 | A1 * | 7/2002 | Pulley et al. | 709/224 |
| 2002/0152120 | A1 * | 10/2002 | Howington | 705/14 |
| 2005/0171808 | A1 * | 8/2005 | Saenz et al. | 705/1 |

FOREIGN PATENT DOCUMENTS

WO WO 00/77682 A1 * 12/2000

OTHER PUBLICATIONS

Morris, Charles E. Technology Update: SCADA evolves towards MES, Mar. 1, 2001, printed from Internet□□.*

CiTect, PlantzBusiness Solutions, Jul. 4, 2000, printed from Internet□□.*

NSEC News: 2000 Fourth Quarter, circa 2000, printed from Internet.*

Tufte, Edward R.: The Visual Display of Quantitative Information, see attached pages.*

Tufte, Edward R.: The Visual Display of Quantitative Information.

Tufte, Edward R.: The Visual Display of Quantitative Information, circa 1983, Graphic Press, pp. 176-191.

Morris, Charles E. Technology Update: SCADA evolves towards MES, Mar. 1, 2001, printed from Internet.

CiTect, Plant2Business Solutions, Jul. 4, 2000, printed from Internet.

NSEC News: 2000 Fourth Quarter, circa 2000, printed from Internet.

EP Exam Report, Application No. 02 021 538, dated Jan. 8, 2007.

* cited by examiner

METHOD AND APPARATUS FOR GRAPHICALLY PORTRAYING GAMING ENVIRONMENT AND INFORMATION REGARDING COMPONENTS THEREOF

RELATED APPLICATION DATA

This application is a continuation in part of U.S. application Ser. No. 09/965,785, now U.S. Pat. No. 6,884,170, filed Sep. 27, 2001.

FIELD OF THE INVENTION

The present invention relates to a method and apparatus for representing or portraying a gaming environment including information regarding individual components or elements of thereof, such as gaming machines and table game elements.

BACKGROUND OF THE INVENTION

Gaming systems are becoming ever larger and more complex. Geographically, a gaming system may comprise hundreds of linked or unlinked gaming devices within a single casino. In addition, the systems may now span multiple properties, with gaming machines over a wide geographic area connected to one another or associated with the same system.

Today's gaming systems may have a variety of features or functions which make the system very complex. Of course, the operational components of a gaming system are likely to include a large number of gaming machines, table games, keno stations, cashier workstations, auditor workstation, accounting workstations, and many other related system elements. These system elements are likely to be connected to a host computer via a network. Via this connection, information may be transmitted to each gaming machine or other device and information may be transmitted from each gaming machine or device. This information may comprise a wide variety of information, such as security information and gaming machine activity information.

Each gaming machine may also be associated with a player tracking network. This network may include the same communication links and host computer. However, this portion of the system is specially adapted to perform such functions as receiving player identification, such as by a player tracking card inserted into a card reader at the gaming machine, and tracking of player game play information. This information may include coin in and coin out information from the gaming machine.

A gaming machine may also be associated with a progressive network or system. Here, a group of gaming machines are associated, and amounts wagered may be placed in a common pool which can be won playing any one of the machines associated with the progressive system.

A gaming machine may also be provided with a communication link to a financial system. This system or function includes components arranged to permit a player to use a credit card or similar form of credit associated with an outside financial institution for providing credit for playing the gaming machine.

A gaming machine may also be associated with a cashless transaction system, such as International Game Technology's EZ-PAY™ system. Such a system includes components arranged to print tickets representing monetary value in lieu of dispensing actual currency or coin.

The complexity and size of these gaming systems creates a number of difficulties. It is desirable to be able to determine the location of a specific gaming machine and obtain information regarding its operation. It is surprisingly difficult to locate a particular gaming machine, given the size of the machine. However, in a large casino with thousands of machines, and considering that the layout of the casino may be changed with some frequency, the location of a particular machine is often somewhat difficult to determine.

Generally, the location is known either through a printed chart or by physically traveling to the casino to find the machine. In the first case, information regarding the gaming machine is rather singular, and more general information which may be pertinent to the location of the gaming machine, such as landmarks in the casino or relationships to other machines or banks of machines, may be lacking. In the second case, the detailed information is provided, but only to the person who travels to the gaming machine and physically observes it and the surroundings of the machine in the casino.

It is also often difficult to obtain information regarding a particular machine. The information regarding a particular machine, such as information regarding player activities, security, cashless transactions and the like may be found in different data files and with different computers or host arranged to implement the various functions or systems with which the gaming machine is associated.

A system which provides information regarding components of a gaming system, such as gaming machines and table games, including location information and game machine activity information, is desired.

SUMMARY OF THE INVENTION

The present invention comprises one or more methods and apparatus or systems for graphically representing at least a portion of a gaming environment. Other embodiments of the invention include methods and apparatus for providing information regarding one or more components within the gaming environment, such as gaming machines, table games or the like of a gaming system in that environment via the graphical representation.

One embodiment of the invention comprises a graphical user interface for displaying graphical representation information of a gaming environment to a user. One embodiment of the invention comprises a method of configuring such a graphical user interface. One method includes the step of generating a graphical representation of the gaming environment, the graphical representation including elements graphically representing one or more components of the gaming environment. Another step comprises displaying at least a portion of the graphical representation in a window of the graphical user interface on a display device, the portion of the graphical representation including one or more displayed elements. The elements are displayed in positions relative to one another corresponding to relative positions of the components of the gaming environment which the elements represent. The method also comprises accepting the selection of one or more of the displayed elements, generating information regarding the one or more components of the gaming environment represented by the selected displayed elements of the graphical representation, and displaying at least a portion of the generated information.

In one embodiment, the graphical representation is a three-dimensional representation of the gaming environment. The three-dimensional representation represents the actual physical environment of the gaming environment, such as a casino structure, along with individual components of the gaming environment, such as gaming machines, table games and other game related devices.

One or more embodiments of the invention comprise a system for displaying information regarding a gaming environment which includes gaming devices. In one embodiment, the system includes an information host including a display adapted to display graphical information. A communication link permits information to be transmitted between the information host and at least one gaming device of the gaming environment. A graphical user interface is displayable on the display and comprises a main window and a display area in which a graphical representation of at least a portion of the gaming environment may be displayed. A means is provided for accepting selection of at least one element displayed in the display area corresponding to a gaming device of the gaming environment, as is a means for displaying information regarding that gaming device. The gaming device may comprise a gaming machine, such as a video poker or slot machine. The gaming device may also comprise a table game, accounting workstation, cashier workstation, player tracking device or the like.

In one embodiment, the graphical user interface includes navigation elements. The navigation elements permit a user to navigate the graphical gaming environment information to cause other information to be displayed. The graphical user interface includes a menu which permits a user to initiate one or more functions or applications, such as zooming or manipulating the displayed information.

In one embodiment graphical elements represent a component, such as a gaming machine or table game, of the gaming environment. The graphical elements may be arranged as application or function initiating elements or container elements. In one embodiment, when a graphical element is selected, information regarding the physical component which it represents is provided. The information may be displayed in a window associated with the graphical user interface.

The displayed information may comprise real-time and/or historical information collected or generated by a gaming machine. The information may be transmitted from the gaming machine or from a data collection device, such as an accounting system host or other device.

In one embodiment, graphical elements may be used to represent players or other persons in the gaming environment. When selected, information regarding those players or other persons may be displayed. The information may include, for example, the identity of the player or information regarding the player's reward account.

In accordance with the invention, a gaming environment is graphically represented to a viewer in a manner which represents or mimics the actual or physical gaming environment. The method and system of the invention is arranged to provide a graphical representation of all aspects of casino or gaming system operations, including physical structure details, location information and information regarding the various components or functions of the gaming system, such as gaming machine and table game activity.

The system, including the interface, permits a user to obtain information from or regarding actual devices or persons. The system also permits a user to transmit information to a gaming system device, such as a particular gaming machine.

Further objects, features, and advantages of the present invention over the prior art will become apparent from the detailed description of the drawings which follows, when considered with the attached figures.

DETAILED DESCRIPTION OF THE INVENTION

The invention is a method and apparatus for graphically representing a gaming environment, including details regarding specific components of the environment. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises a method and apparatus for graphically representing a gaming environment. Preferably, the gaming environment is depicted in a three-dimensional graphical representation of the arrangement or layout of the physical environment, such as a casino structure. In one embodiment, the representation includes images or graphical representations of the components of the environment in the surrounding physical environment, i.e. presenting the gaming environment in "virtual" format. The components may comprise individual gaming machines, table games and other gaming devices such as cashier workstations, accounting workstations and other components. A further aspect of the invention comprises a method and apparatus for providing information regarding individual components of the gaming environment from or in the graphical representation.

Figure 1A:
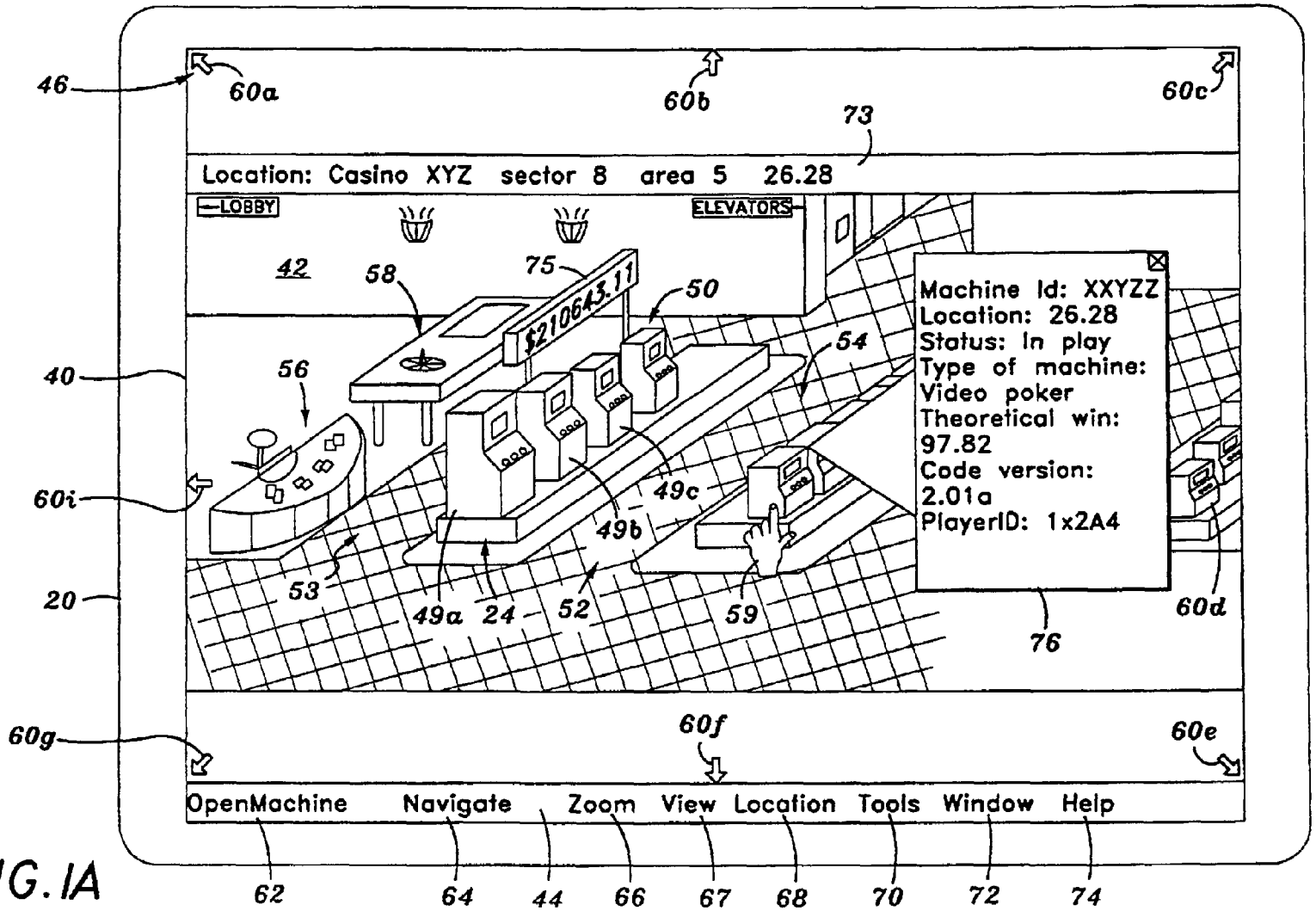
FIG. 1A illustrates a graphical user interface for displaying gaming environment information in graphical format, the interface displaying information regarding a particular gaming device of that environment.

Referring to FIG. 1A, in one embodiment of the invention there is provided a graphical user interface 20. In a preferred embodiment of the invention, the graphical user interface 20 is associated with at least one main application but capable of displaying information associated with one or more sub-applications or functions.

In one embodiment, the graphical user interface 20 is arranged to display information provided by an application or function which generates casino environment image information. In addition, in one or more embodiments, the graphical user interface 20 is arranged to display information provided from other applications or functions, and particularly those associated with individual functions or systems of a casino. These other applications or functions may be player tracking, casino accounting, security and the like.

Figure 2:
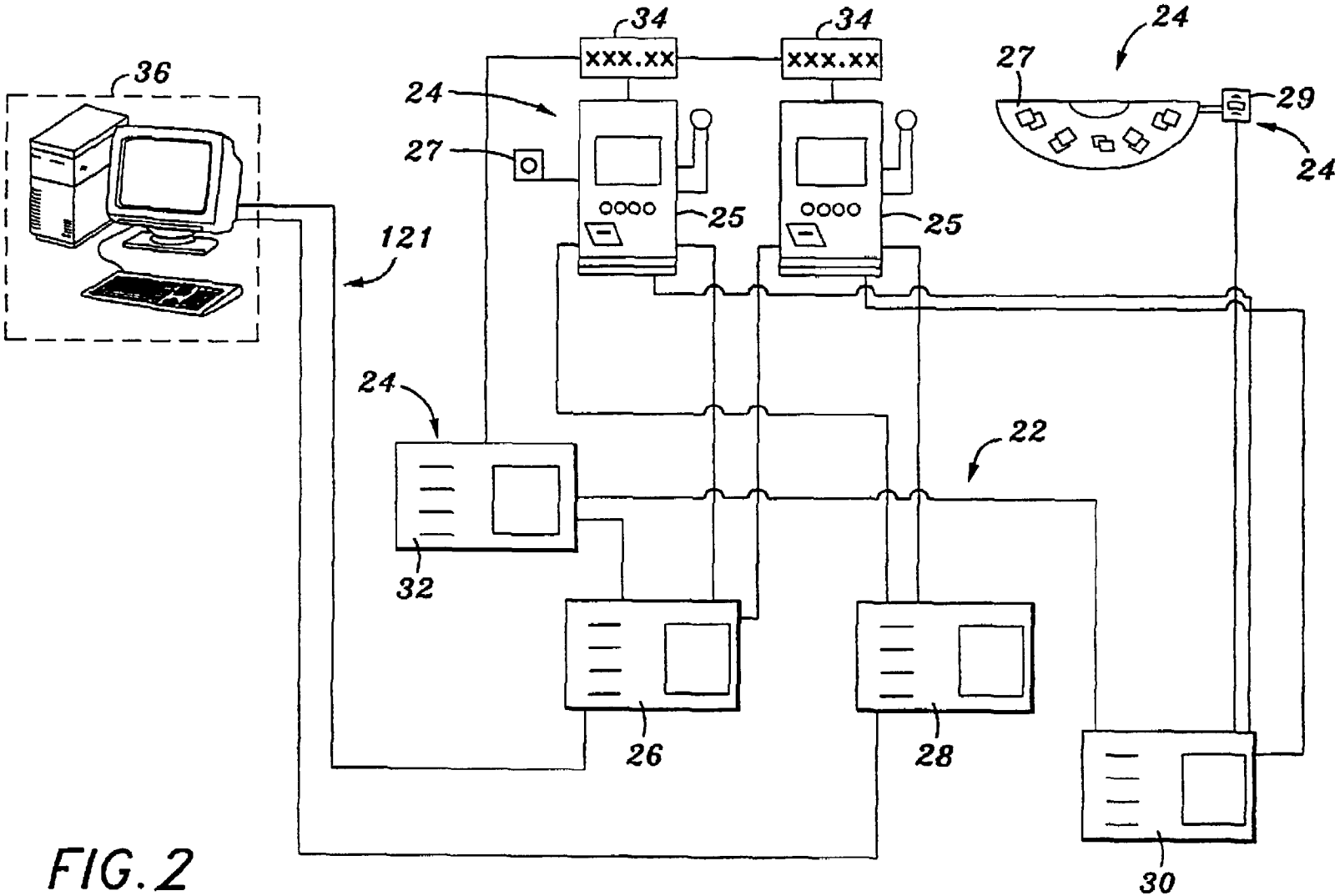
FIG. 2 illustrates a gaming system of the type which may be graphically illustrated and associated apparatus for illustrating the environment.

FIG. 2 illustrates one example of a gaming environment with which the graphical user interface 20 may be utilized. The gaming environment comprises a gaming system 22 located in a physical environment (not shown). In one embodiment, the physical environment includes at least a portion of a physical structure, such as casino, housing one or more components of the gaming system 22.

The gaming system 22 includes a plurality of gaming system devices 24 or components. The gaming system devices 24 may include gaming machines 25, such as those known as video or slot machines. The devices 24 may also include "table" games 27 such as Blackjack and Roulette. The gaming devices 24 may also include components or devices such as player tracking card readers 29, coin counters and the like, which devices or components may be linked or associated with other devices. The devices or components may also comprise computers or servers and communication equipment, cashier and accounting workstations and a wide variety of other elements.

In one embodiment, the gaming system 22 may include a variety of sub-systems. These sub-systems may be partially or fully independent of one another or may be related. In one embodiment, each system may be included or be part of a network.

In one embodiment, the gaming system 22 may include a game presentation/operation system which includes at least one game server 26. The game server 26 may comprise a computing device including a processor and a memory. The game server 26 may be adapted to perform a variety of functions. This functionality may be implemented by software and/or hardware of the server 26. In one embodiment, the game server 26 may be arranged to provide information or instructions to the one or more gaming devices 24 or individual gaming system components. The information may comprise game code and control data. In one embodiment, the game server 26 may also be arranged to accept information from the gaming devices 24 or components. For example, the game sever 26 may accept information regarding the status of operation of a particular gaming system device 24 (such as "normal" or "malfunction").

In one embodiment, the game server 26 is part of a network which includes a communication link between the game server 26 and each gaming system device 24 or other component with which communication is desired. A communication interface may be associated with the game server 26 and each device or component for facilitating the communication. The communication interfaces may have a variety of architectures and utilize a variety of protocols such as IEEE-1394 (FIREWIRE™) or Ethernet in the case where the communication link is a wired link, or 802.11b or BLUETOOTH™ in the case of a wireless link. The communication links may transmit electrical, electromagnetic or optical signals which carry digital data streams or analog signals representing various types of information.

In one embodiment, such as when the gaming device 24 comprises a gaming machine 25, the device may include a master gaming controller which controls the functions of game operation. The communication interface may be associated with the master gaming controller, permitting data to be transmitted between the game server 26 and the master gaming controller.

In one embodiment, the gaming system 22 may include a player tracking system which includes at least one player tracking server 28. The player tracking server 28 may also comprise a computing device including a processor and a memory. The player tracking server 28 is preferably adapted to perform player tracking functions, as is well known in the art. For example, the player tracking server 28 may store information regarding the identities of players and information regarding the game play of those players. This information may include time of play, coin in/coin out or other monetary transaction data, and in an arrangement where players are awarded points based on play, a player's point total.

Once again, the player tracking system includes a network comprising a communication link provided between the player tracking server 28 one or more of the gaming devices 24 having a player tracking function or other components of the gaming system 22 associated with the system. In one embodiment, such as where the gaming device 24 comprises a gaming machine, the device may include a management interface board which controls a card reader. The management interface board may be arranged to receive data from the master gaming controller of the gaming system device 24. A communication interface is associated with the management interface board, permitting data to be transmitted between the player tracking server 28 and the management interface board.

In the case of table games and the like, a card reader 29 may be associated with, such as located near, the table. A player may utilize the card reader to identify themselves. Information regarding play of the table game may be input through an input device by a dealer, coin counter or the like, and this information may be transmitted to the player tracking server 28.

In one embodiment, the gaming system 22 may include an accounting system which includes at least one accounting server 30. The accounting server 30 may comprise a computing device including a processor and a memory. The accounting server 30 is preferably adapted to perform financial related functions, such as track financial transactions such as bets and payouts, and perform reconciliations with monies collected from the gaming system devices 24, such as gaming machines 25, tables games 27 and the like. The accounting server 30 may be associated with a wide variety of devices, including individual gaming system devices 24 and other servers. Once again, a communication link is preferably provided between the accounting server 30 and each device with which communications is desired.

In one embodiment, the gaming system 22 may include a progressive award system which includes at least one progressive server 32. The progressive sever 32 may comprise a computing device including a processor and a memory. The progressive server 32 may be adapted to generate progressive award information. In one arrangement, the progressive server 32 may obtain information regarding amounts bet at specific gaming system devices 24, such as gaming machines 25 or table games 27. Utilizing this information, a progressive jackpot award amount may be generated and updated. The information may be transmitted to one or more displays 34 associated with participating devices 24. Once again, a communication link is preferably provided between the progressive server 32 and each device with which communications is desired. For example, a link may be provided between the progressive server 32 and accounting server 30 for providing payout information to the accounting server 30.

It will be appreciated that the communications links between the various components may be separate and distinct or may be commonly used. It will also be appreciated that one or more of the functions or applications described above may be consolidated, such as at a common server or host. Further, other components for implementing other functionality may be provided. For example, a variety of computing devices, such as user stations, may be connected to the various systems. Printers and other peripheral devices may also be connected to each network or system.

As is known in the art, such a gaming system 22 is generally located at least partially in one or more physical gaming environments, such as a casino. The casino may include publically accessible game areas where certain of the gaming system devices 24, such as gaming machines and table games are located, as well as secure areas where the servers and other components are located.

In a preferred embodiment of the invention, a virtual information host 36 is associated with or comprises a portion of the gaming system 22. In one embodiment, the host 36 comprises a computing device which includes a processor, memory and a display. One embodiment of the host 36 is described in greater detail below. The virtual information host 36 may be one or more devices separate from devices performing other functions of the system 22, or may be integrated with existing devices.

In a preferred embodiment, the virtual information host 36 is arranged to perform the above-stated functions of generating and displaying casino gaming system or "gaming environment" graphical information and information regarding one or more components of the gaming system or environment. This function includes the generation and display of the graphical user interface 20.

The graphical user interface 20, and thus the functionality of the virtual information host 36, will be described with reference primarily to FIG. 1A. In a preferred embodiment, the graphical user interface 20 includes a main window 40. The main window 40 may comprise a variety of elements having a variety of shapes and sizes. In general, the main window 40 comprises an element displayed on or by a device, such as a video screen.

In a preferred embodiment, when displayed, the main window 40 provides a gaming system environment information and permits interaction with an application executed by or function being performed by the virtual information host 36 and, as described below, one or more other devices. In the embodiment illustrated, the main window 40 includes a display area 42, one or more menu elements 44 and one or more control or navigation buttons 46.

Preferably, graphical information regarding or representing a gaming environment is illustrated in the display area 42. The display area 42 preferably comprises a portion or field of the main window 40. This display area 42 portion of the main window 40 may be referred to as the data panel, window or viewport.

In one embodiment, the information which is displayed in the display area 42 preferably comprises a three-dimensional representation of a gaming environment. By gaming environment, it is meant the physical arrangement of components of the gaming system along with the related physical environment in which that system or its components reside. This environmental information may include, but is not limited to, the components of the gaming system, the physical arrangement of the components of the gaming system, and one or more portions of the physical environment in which the system is located, including the relationship of the components to the environment.

One example of such information is illustrated in FIG. 1A. As illustrated, the information includes the representation of one or more of the gaming system devices 24 (as described above, the term gaming system device includes, but is not limited to, any component of the gaming system, including electronic, electromechanical, mechanical or other devices, elements or structures). These representations preferably comprise images, either actual images such as photographic information in digital form, or generated representations, of the gaming system devices 24 of the system 22. Preferably, if not an actual image of the gaming system device 24, the representation portrays information useful in identifying the gaming system device 24, such as the particular type of gaming system device. By "type" it is meant slot type machine, video type machine, table game, server, workstation or the like. In addition, the representation may more particularly identify the device 24, such as by particular game or manufacturer.

In a preferred embodiment, the representation of each gaming system device 24 is illustrated in a location on the display relative to all other gaming system devices 24 which represent the actual relative locations of the gaming system devices 24 of the gaming system 22 being portrayed in their actual physical environment.

In one embodiment, one or more aspects of the actual physical environment in which the components of the gaming system 22 are located is displayed. For example, a representation of a casino which is housing the gaming system 22 may be displayed. Once again, the aspects of the casino or other physical environment are preferably illustrated in relative and representative form to the actual physical environment, including size, relative location and the like.

An example of a portrayal of an actual gaming environment is illustrated in FIG. 1A. As illustrated, the gaming system includes gaming system devices such as gaming machines 49*a, b, c* arranged in a first bank 50 of gaming devices. An isle 52 separates the first bank 50 of gaming devices from a second bank 54 of gaming devices. An isle 53 also separates the first bank 50 of gaming devices from a number of other gaming devices including a Blackjack table 56 and a Roulette wheel 58. Again, these displayed images correspond to an actual (in this case, exemplary) physical gaming environment.

Preferably, the information which is displayed to the user aids the user in correlating the illustrated information with the actual physical environment. A wide variety of information may be displayed to aid this function. For example, referring to FIG. 1A, the information which is illustrated preferably includes details regarding the physical environment of the gaming system 22, which details aid the user in identifying the corresponding physical location of the individual components or devices of the system. This detail may include the illustration of casino walls, hallways, isles, significant fixtures such as light fixtures and signage, doors and the like. The detail may also include information such as the type of flooring, including reproduction of carpet designs, wall covering and a variety of other information.

Preferably, a variety of functions are provided for manipulating the information which is displayed in the display area 42. In one embodiment, a selector 59 is provided for selecting elements in the window 40. This selector 59 may comprise, as is known in the art, a mouse pointer or as illustrated, a hand with pointed finger. The selector 59 may be guided by a mouse, track-ball or a wide variety of other user input devices. Other means may be provided for selecting elements, such as by a menu or selection buttons, such as use of the TAB or arrow keys of a keyboard.

As described, a plurality of navigation elements 46 may be provided. In one embodiment, the navigation elements 46 comprise directional arrows 60*a, b, c, d, e, f, g, i*. Selection of one of these arrows 60*a-g*, I preferably results in the display of information regarding an area of the gaming environment which is available in the direction of the arrow. For example, if a user selects the arrow 60*d*, then the field of view is shifted to the right. Information regarding the gaming system and related environment which lies in this direction is thus displayed in replacement of the information regarding the current location. In one embodiment, selection of a particular arrow 60 results in a predetermined distance of movement.

In addition, functions may be performed via menu selections. As illustrated, the menu 44 includes a number of menu elements. In one embodiment, the menu elements comprise "open machine" 62, "navigate" 64, "zoom" 66, "view" 67, "location" 68, "tools" 70, "window" 72, and "help" 74.

Upon selecting one of the menu selections, one or more functions associated with that selection may be presented to the user. These functions or selections may be illustrated in a hierarchical or other menu format. With respect to the "open machine" 62 selection, a user may be provided with a number of sub-selections, such as "open accounting," "open security," "open operating data" and the like. Each one of these sub-selections preferably results in the generation or display of certain information regarding a gaming system device which is illustrated in the display area 42, which device and information corresponds to an actual gaming system device of the gaming system 22.

With respect to the "navigate" 64 selection, a user may be provided with sub-selections such as "move right," "move left" and the like. Other selections may be provided, such as a user's selection of a specifically designated area.

With respect to the "zoom" 66 selection, a user may be provided with sub-selections such as "zoom in," "zoom out" and "percentage zoom." Such selections may be used to change the magnitude of the size of displayed information. For example, "zoom out" preferably causes the scale of the displayed elements to reduce or become smaller, such that a larger representative area of the gaming environment is displayed in the display area 42. The "zoom in" features preferably causes the scale of the displayed elements to increase or become larger, such that a smaller representative area of the gaming environment is displayed in the display area 42.

With respect to the "view" 67 selection, a user may be provided with a number of sub-selections such as "camera view" or "archive view." As described below, using such features a user may obtain a photographic image of a particular component or live video feed from a camera including the component within its field of view.

With respect to the "location" 68 selection, a user may be provided with options for the display of specific areas of a gaming environment. These locations may be pre-designated, such as "entrance" or the like.

With respect to the "tools" 70 selection, a user may be provided with a variety of function options such as changing the color of displayed information, contrast, importing and exporting of information, saving of data and the like.

With respect to the "window" 72 option, a user may be provided with options such as sizing of the window, closing or reducing the window 40. The user may also be provided with the option of making the display area 42 a full screen (i.e. no borders displayed). The user may also be provided with the option of changing the format of information displayed in the window 40, such as adding visible tool bars, changing the style of the navigation elements, and adding or removing information bars or areas. For example, in one embodiment, a "location" bar 73 may be displayed in the window 40. The "location" bar 73 may display information regarding the information of the location of the graphical components which are presently illustrated in the display area 42, such as the name of the casino and more detailed mapping information.

With respect to the "help" 74 selection, a user may be provided with a variety of help functions. These functions may include an index of help topics.

In one embodiment, the various functions which are provided by the menu 44 are enabled by software and/or hardware. For example, the virtual information host 36 may include computer executable code arranged to "zoom" the information which is displayed in the display area 42.

A variety of other menu selections may be provided, as is known. For example, menu selections may include "print" for printing displayed information.

In one or more embodiments, one or more of the elements which are displayed in the display area 42, such as represented gaming system devices, may comprise a container element. In general, a container element is an element which contains other elements or information. One or more of the elements displayed in the display area 42 may comprise application initiating elements. Application initiating elements comprise elements which, when selected, cause an application to be initiated or run.

In one embodiment, when a particular displayed element is selected, data associated with that element is displayed. The information which is displayed is dependent upon the element which is selected. For example, if the selected element is the gaming machine or table game, then information regarding the physical gaming machine or gaming table to which the displayed element corresponds is displayed. If the selected element is a progressive meter 75, then information regarding that device is displayed.

The manner by which the information is generated and displayed may vary. As described, the displayed element may comprise a container with which information is associated. For example, a displayed gaming system device may be configured similar to a file folder in a computer-based application window. Data from other applications or elements may be associated with the container so that when the container is selected, the associated information is accessible, accessed or displayed.

In another embodiment, the selection of a display element causes an underlying function or application to be initiated. Preferably, this function or application is arranged to generate and then display information associated with the display element. For example, upon selecting a particular gaming system device, an application may be initiated which polls various of the devices of the gaming system, such as servers or hosts, for information regarding that device.

The information may be displayed in a wide variety of manners. In one embodiment, the information may be displayed in a new window 76 which has characteristics separate from the main window 40. For example, the new window 76 may be moved, re-sized, and closed independent of the main window 40. In another embodiment, the information may be displayed in the main window 40.

In one embodiment, a user may be required to select by a menu or by click of a mouse button. In another embodiment, information may be presented when the selector 59 is moved over a particular element or as the user navigates through the virtual environment. For example, a window may automatically open and present information regarding a component positioned under the selector 59 or when touched by the user in a touch-display format.

The type of information which may be displayed may vary. In one embodiment, the information may comprise one or more selectable elements themselves, such as a menu of selections for the user. In another embodiment, specific information may be automatically configured and displayed. Such an arrangement is illustrated in FIG. 1A. As illustrated, a variety of information may be displayed regarding the selected device. In the case of a gaming system device 24, the information may include the identification of the device, such as by serial number or other identifier. The information may include the location of the device. As described below, in an instance where the graphical gaming system information is arranged based upon predetermined grid arrangement which is correspondingly associated with the physical environment of the gaming system, then grid coordinates (i.e. 26:28 as illustrated) may be displayed.

The information may include a wide variety of information obtained from the actual gaming system device 24 which corresponds to the graphical representation. The information may also come from other sources, such as the individual servers or hosts. For example, accounting information such as total coins (or money) in and coins (or money) paid out by the gaming system device during periods of time may be displayed. Other information such as the operating status of the gaming system device and specific information about operating software may be provided from the gaming system device 24 via the game server 26.

The graphical user interface 20 may be configured in a wide variety of manners. For example, the navigation element, menu elements and the like may comprise text, buttons, symbols or take other forms. These elements, such as the arrows 60, menu elements and the like may have a variety of shapes and sizes.

In one embodiment, the display may be touch sensitive, allowing a user to select a display element directly. In such event, the various elements such as navigation arrows 60 and menu elements may be arranged as buttons which are sized for selection by the finger-tip touch of a user.

In one or more embodiments, one or more external windows (not shown) or other elements may be associated with the graphical user interface 20. Such windows or elements may be associated with, but not form a portion of, the main window 40 or its components. In one or more embodiments, the element may comprise a window in which information may be displayed, or may comprise a button, or panel including information, or other graphical elements having a variety of forms and configurations. In one embodiment, such an external window may be associated with an entirely different application from that which the graphical user interface 20 is associated. In another embodiment, a window may be displayed which is associated with an element of the graphical user interface 20.

In accordance with the present invention, there is provided a method of configuring a graphical user interface, such as the graphical user interface 20 described above. One embodiment of the invention comprises displaying a graphical representation of at least a portion of a gaming environment comprising a physical gaming system and its associated environment, and displaying information regarding one or more components of that gaming system.

Figure 3:
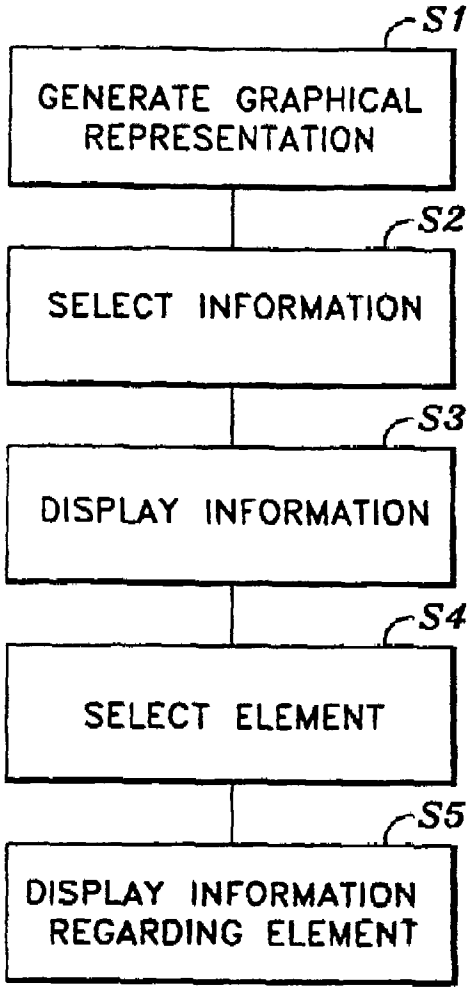
FIG. 3 is a flow diagram of a method of graphically representing a gaming environment and providing gaming environment information in accordance with an embodiment of the invention.

An embodiment of one such method in accordance with the invention will be described with reference to FIG. 3. In a first step S1, a graphical representation of the gaming environment, or at least a portion of the gaming environment, is generated. The information may be generated in a wide variety of manners. In one embodiment, information is provided to a graphics application regarding the gaming environment. In one embodiment, an actual gaming environment, such as a gaming system within a casino, is mapped. The mapping may comprise physically locating components of the gaming system and related environmental features, such as the casino structure, on a grid. In this manner, the absolute and relative locations of the various components is known. Other types of coordinate systems may be utilized, as well as absolute distance measurements.

This mapped information may then be used to construct the computer graphic model of the system. In one embodiment, the various gaming system components and related environmental features may be computer generated images. In another embodiment, of the actual components and features may be converted into digital data for display. Individual graphical components may be assembled into complete views. The data may be stored, such as at a memory of the virtual information host 36. In a preferred embodiment, the graphical components are associated with triggers or are otherwise configured as the above-referenced containers or application or function initiating elements. In this manner, when displayed and selected, the associated information is displayed or underlying application is initiated.

In a second step S2, information is selected to be displayed. This selection may be made by a user using the menu 44. For example, the user may select the "location" 68 selection and type in particular coordinates. In another embodiment, a default view may be illustrated as a starting point for the user.

In a third step S3, the selected information is displayed. In one embodiment, this step comprises obtaining the graphical information and causing the display to display the information.

In a step S4, a user selects a particular graphical element, such as a representation of a gaming system device. In response, in a step S5 information regarding that device is displayed. In one embodiment, this step may include the steps of sending a request for information to a remote device, such as a host or server, and then obtaining the information from that device.

A variety of other methods are contemplated as within the scope of the invention, and the steps may of the methods of the invention may be performed in a variety of sequences. In one embodiment, the method includes the step of generating a graphical user interface and displaying generated graphical gaming environment or gaming system information using the interface, such as in the display area of the interface. The method also includes the steps of accepting input from a user, such as for effecting navigation or requesting information regarding a particular displayed element.

In one embodiment, each gaming system device 24 or component is uniquely identifiable, and a graphical representation of a component is uniquely associated with an identified physical component. When a user selects a particular graphically represented gaming system device, a request for information regarding that gaming system device from a server or host is made by using the identifier for that device. This identifier may comprise a machine I.D., serial number or the like.

A variety of other embodiments of the invention are contemplated. In one embodiment of the invention, the virtual information host 36 may be provided with a communication link to one or more cameras, such as casino security cameras. If desired, a user of the graphical user interface may be permitted to view the physical device to which the graphical representation corresponds using information from such a camera or cameras. As described above, a "view" 67 menu selection may be provided. By selecting a particular element in the display area 42 and the "view" selection, actual photographic information of the component in the physical environment may be presented to the user.

In one embodiment, when the user selects the "view" option, the virtual information host 36 is arranged to obtain photographic information. Such information may be obtained from a particular camera or cameras through a communication link directly with the camera(s), or through a centralized security or other monitoring system through which data feeds from the one or more cameras is provided. The information may also comprise an archived image of the component.

For example, referring to FIG. 2, a camera 27 or other image collection device may be configured to collect image information regarding one or more gaming system devices 24 and/or activities and objects (including players). By selecting the "view" 67 menu selection, a user may be permitted to select a particular camera, gaming system device 24 and/or area for which collected image information is desired. This image information may then be displayed to the user. The image information may comprise individual frame or streaming video information.

The photographic information may be displayed in a variety of manners. In one embodiment, the information is displayed in a new window located in the display area 42, in similar manner to the window 76. In one embodiment, the image information may be stored by the user. For example, when particular image information is selected, the user may utilize a "store" feature (such as provided in a sub-menu) to store the information for later use.

Of course, a wide variety of information may be provided to the player using the graphical user interface 20. For example, audio or audio and video information from the physical gaming environment may be provided.

The various components or elements of the graphical user interface 20 may be arranged in a variety of configurations. In general, it is desired, however, that the interface 20 provide a user with a consolidated "picture" of one or more portions of the gaming system and be capable of providing specific information regarding one or more components of that gaming system. In this regard, the gaming environment which is depicted may be referred to as a "virtual casino" in that it represents the casino in computer generated/presented format.

While it is preferred that the gaming system be represented in a three-dimensional form, other formats may be provided. In one embodiment, the gaming system may be represented in a two-dimensional format. In another embodiment, the gaming system may be represented using actual images of the gaming environment. For example, photographs may be taken of each gaming device 24 and the image of each particular gaming machine may be displayed in the represented environment with its photograph or other image. In another embodiment, live video information may be displayed to represent the environment. Other information may be imposed upon that image information to aid the user in identifying features and obtaining information. Alternatively, the image information may be imposed over a template, whereby when the user selects a particular displayed element, such as a particular gaming machine, the selection results in selection of the gaming machine as identified by its underlying template.

In one embodiment of the invention, information regarding activities or events located remote from the user are displayed in real-time to the user. When a user selects a particular gaming system device 24, information regarding that device is displayed to the user in real time. For example, when a user selects a particular gaming machine 59, as illustrated in FIG. 1A, information which is being generated by the gaming machine 59 is preferably provided to the user as it is generated. This information may comprise, for example, player events such as a player's input of a player card, coins in and coins out, and a wide variety of other information, such as identification of a game currently being played, results of games and the like.

In another embodiment, as also described, the user may obtain historical information. As illustrated in FIG. 1A, such information may comprise information previously generated or information which was generated from previously generated information, such as actual win or hold percentage over time, coins in and coins out over time, number of games played over time, and similar information.

It will be appreciated that one or more components of a gaming environment or system may be located in more than one geographic location. For example, International Game Technology's MEGABUCKS™ system includes gaming system devices which are located in multiple casinos. In an embodiment of the invention, it is contemplated that the system may be modeled or represented in similar manner to that described above. In such an embodiment, at one "zoom" level, an overview graphical representation of the system may be provided, such as one in which all of the casinos having such machines are illustrated. A user may then select a particular casino or location and another level of information, such as a casino level detail as illustrated in FIG. 2 may be illustrated.

In this regard, the method and apparatus of the invention is not limited to presentation of information regarding a single gaming system or a portion of a gaming system at only a single location. It is contemplated that a user may be presented information regarding gaming systems at different casinos or a gaming system spread among or including multiple casinos. In such an embodiment, as described above, the user may be provided with a means for selecting the particular portion or area of the gaming system or the particular gaming system or casino property which the user would like information about. In an embodiment such as where the gaming system is distributed among multiple casinos or locations, the virtual information host 36 may communicate with gaming system devices 24 at the individual casinos.

In one or more embodiments, means other than arrows or the like may be provided for changing the illustrated information or otherwise "navigating" the information. In one embodiment, navigation may be permitted using the selector 59. For example, as a user moves the selector 59 (such as with a track-ball) over the displayed gaming system information, the displayed information may "move" as well. For example, in the embodiment illustrated in FIG. 1A, if a user were to move the selector 59 towards the area marked "elevators," this portion of the displayed area would move towards the bottom of the display area 42, and additional information above that area would be displayed.

As noted, a variety of information regarding individual gaming system devices or components may be presented. This information may include device or structural data such as serial number, manufacturer and the like. The information may also include operational data, such as power on/off, malfunction and the like. The information may also include game-related information, such as amounts bet and awarded, percentage hold and the like. In one or more embodiments, the statistics from more than one gaming system device may be aggregated, such as by selecting an entire bank of gaming machines or a group of table games.

In one embodiment, graphical representations of players may be included. For example, in the event information is received that a particular gaming machine is in play by a player, the graphical representation of the environment may be updated to add a graphical representation of a player at that particular gaming machine. Likewise, graphical representation of players and dealers may be illustrated with respect to table games. In this manner, a user of the system may easily identify the gaming system devices which are current in use from those which are not.

Figure 1B:
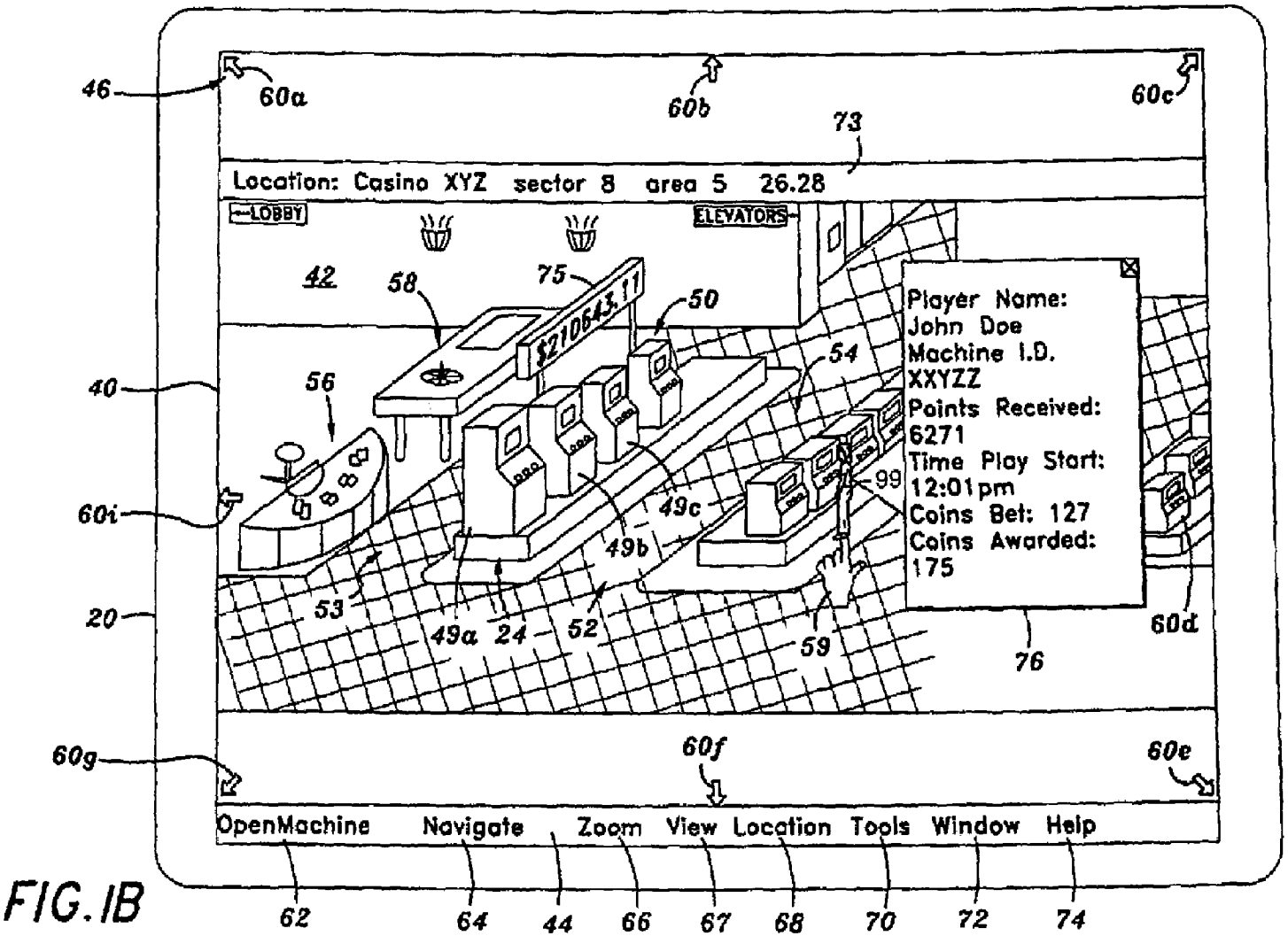
FIG. 1B illustrates a graphical user interface for displaying gaming environment information in graphical format, the interface displaying information regarding a player of a gaming device of that environment.

In a preferred embodiment of the invention, as illustrated in FIG. 1B, a user may obtain information regarding players (e.g., 99) or other persons in the gaming environment. In one embodiment, the user may select a player (e.g., 99) to obtain information regarding that player. Information may be obtained whether the identity of the player is known or not. For example, if the identity of the player is not known, the gaming machine 25 may still provide information that a player is playing. In that event, a graphical representation (or actual image, such as obtained from a camera) of the player may be provided. When the user selects that representation, information may be displayed, such as collected and generated information regarding the time play began, coins in and coins out and the like.

As described above, a player may identify themselves by using a player tracking card or the like. In such an event, the user may obtain specific information regarding the player and the player's activities, such as tracked by the player tracking server (see FIG. 2). This information may comprise any of the wide variety of information which is known to be collected or generated with such a system, such as the name of the player, bonus or awards points accrued to the player or the like, as illustrated in FIG. 1B.

In this embodiment, a user may obtain information which allows the user to make decisions regarding the player. For example, by viewing the historical and/or real time play of a player (e.g., 99) as illustrated in FIG. 1B, the user may elect to award the player a special bonus, such as a bonus number of accrued points which the player may utilized for free game play or prizes, as is known in the art of player rewards programs. In one embodiment, menu features may be provided for permitting the user to perform such functions, such as via the graphical user interface 20. In one embodiment, such actions may be transmitted over the gaming system 22 (see FIG. 2) back to the player, so that the player is made aware of the award.

In a similar manner, a user may obtain information regarding other persons. For example, a user may obtain information regarding a dealer at a Blackjack table 56. A dealer may be required to log in when they begin dealing at a particular table 56. Further, equipment may be used, as described, for tracking game play, including bets and amounts paid at the table. By selection upon the representation of the dealer, the user may obtain information such as the identity of the dealer, their time at the table and related information.

In one or more embodiments, other options may be provided for manipulating the graphical information. For example, in one embodiment, a user may be permitted to move graphical elements, such as individual gaming system devices (such as representations of gaming machines or table games). In this manner, a user may be permitted to reconfigure the virtual gaming environment or casino and visually inspect the new configuration. This information may be useful in changing the actual physical environment/arrangement of the system.

For example, a user may utilize the graphical representation to reconfigure the gaming environment. For example, a casino may wish to reconfigure their gaming floor, such as by moving one or more gaming machines. A user may obtain a visual representation of the gaming floor as reconfigured by moving the representations of the gaming system devices 24. In one embodiment, the user may "drop and drag" the representations, or may use input commands to effect the movement.

In one embodiment, once one or more of the representations of the gaming devices 24 have been moved, reconfiguration information may be generated and output. This information may comprise, for example, the identification of moved devices and their new locations, such as in coordinate or other form. Technicians or workers may then utilize those instructions to move the physical devices to their intended locations.

In another embodiment, the physical gaming devices may be moved and then the system of the invention may utilize input information to change the represented environment. For example, technicians may input new location information for moved devices, and the system may then utilize that information to generate a new graphical representation for use by the user. In this manner, the representation is always accurate of the true environment.

In one embodiment, the user may be permitted to interact with individual gaming system device by sending information, such as control instructions, to the device. For example, a technician may query a device using the system and then send information to the device, such as a reset code. A user may also use the system to update control code, such as gaming machine game code using the system. In this arrangement, information or instructions are provided the virtual information host 56 to the one or more devices.

In one embodiment, a user may cause information to be transmitted to a gaming system device for use by a technician or similar party. For example, a user may obtain information regarding a particular gaming machine using the interface 20 and determine that the gaming machine should be reconfigured. The user may cause a work ticket to be printed from a ticket printer or dispenser at that gaming machine for use by the technician. Such work tickets may also be printed to provide trouble-shooting or similar information to a technician or other party at the gaming system device. The information may also be displayed instead of being printed.

In general, the graphical user interface and system permit a party to obtain information regarding gaming system devices and transmit information to those devices. Advantageously, the interface provides a convenient means for recognizing and utilizing the information.

A variety of methods have been described above which, as indicated, may be implemented via the virtual information host 36. In general, embodiments of the invention can be implemented as computer software in the form of computer readable code executed on a general purpose computer such as a virtual information host having the form of a computing device configured as illustrated in FIG. 4, or in the form of bytecode class files executable within a Java™ runtime environment running on such a computer, or in the form of bytecodes running on a processor (or devices enabled to process bytecodes) existing in a distributed environment (e.g., one or more processors on a network).

Figure 4:
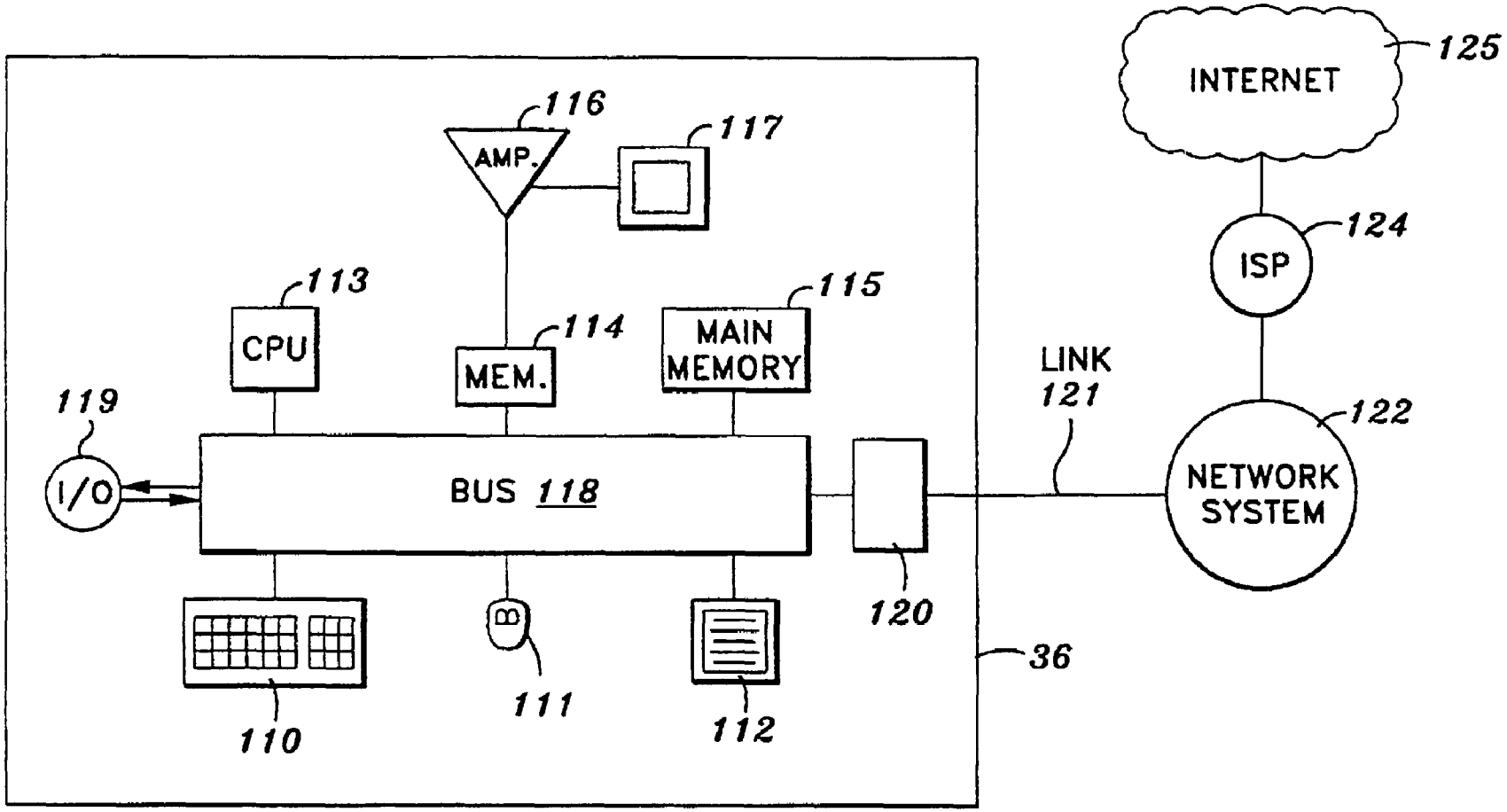
FIG. 4 illustrates one embodiment of an apparatus for use in displaying a gaming environment in graphical form in accordance with the invention.

As illustrated in FIG. 4, the virtual information host 36 may include user input devices such as a keyboard 110 and mouse 111 which are coupled to a system bus 118. The keyboard and mouse are for introducing user input to the computer system and communicating that user input to a processor 113. Other suitable input devices may be used in addition to, or in place of, the mouse 111 and keyboard 110. The I/O (input/output) unit 119 coupled to system bus 118 represents such I/O elements as a printer, A/V (audio/video) I/O, etc.

The host 36 may include a video memory 114, a main memory 115 and a mass storage 112, all coupled to the system bus 118 along with the keyboard 110, the mouse 111 and the processor 113. The mass storage 112 may include both fixed and removable media, such as magnetic, optical or magnetic optical storage systems or any other available mass storage technology. The system bus 118 may contain, for example, sixty-four address lines for addressing the video memory 114 or the main memory 115. The system bus 118 also includes, for example, a 64-bit data bus for transferring data between and among the components, such as the processor 113, the main memory 115, the video memory 114 and the mass storage 112. Alternatively, multiplex data/address lines may be used instead of separate data and address lines.

In one embodiment of the invention, the processor 113 is a microprocessor manufactured by Sun Microsystems, Inc., such as the SPARC™ microprocessor, or a microprocessor manufactured by Motorola, such as the 680X0 processor, or a microprocessor manufactured by Intel, such as the 80X86, or Pentium processor. However, any other suitable microprocessor or microcomputer may be utilized. The main memory 115 is comprised of dynamic random access memory (DRAM). The video memory 114 is a dual-ported video random access memory. One port of the video memory 114 is coupled to a video amplifier 116. The video amplifier 116 is used to drive a cathode ray tube (CRT) raster monitor 117. The video amplifier 116 is well known in the art and may be implemented by any suitable apparatus. This circuitry converts pixel data stored in video memory 114 to a raster signal suitable for use by the monitor 117. The monitor 117 is a type of monitor suitable for displaying graphic images and may comprise other than a CRT, such as an LCD or plasma type display.

As described above and illustrated in FIG. 2, in one embodiment, the host 36 is in communication with one or more devices of the gaming system 22. The host 36 thus preferably includes a communication interface 120 which is coupled to the system bus 118. The communication interface 120 provides a two-way data communication coupling via a network link 121 to the local network 122. For example, if the communication interface 120 is an integrated services digital network (ISDN) card or a modem, the communication interface 120 provides a data communication connection to the corresponding type of telephone line, which comprises part of the network link 121. If the communication interface 120 is a local area network (LAN) card, the communication interface 120 provides a data communication connection via network link 121 to a compatible LAN. The communication interface 120 may have a variety of architectures and utilize a variety of protocols such as IEEE-1394 (FireWire™) or Ethernet in the case where the link 121 is a wired link, or 802.11b or Bluetooth™ in the case of a wireless link. In any such implementation, the communication interface 120 sends and receives electrical, electromagnetic or optical signals which carry digital data streams representing various types of information.

The network link 121 may provide data communication through one or more networks to other data devices. For example, the network link 121 may provide a connection through one or more local networks, such as the above-described progressive network, player tracking network or the like. In addition, the link 121 may provide a connection to data equipment operated by an Internet Service Provider (ISP) 124. The ISP 124 may in turn provide data communication services through the world wide packet data communication network now commonly referred to as the "Internet" 125. The local network(s) and Internet 125 both use electrical, electromagnetic or optical signals which carry digital data streams. The signals through the various networks and the signals on the network link 121 and through the communication interface 120, which carry the digital data to and from the host 36, are exemplary forms of carrier waves transporting the information.

The virtual information host 36 can send messages and receive data, including program code, through the network(s) via the network link 121 and communication interface 120. Application code may be embodied in any form of computer program product. A computer program product comprises a medium configured to store or transport computer readable code, or in which computer readable code may be embedded. Some examples of computer program products are CD-ROM disks, ROM cards, floppy disks, magnetic tapes, computer hard drives, servers on a network, and carrier waves.

The computer system comprising the virtual information host 36 as described above is for purposes of example only. An embodiment of the invention may be implemented in any of a wide variety of computer systems or programming or processing environments.

Figure 5:
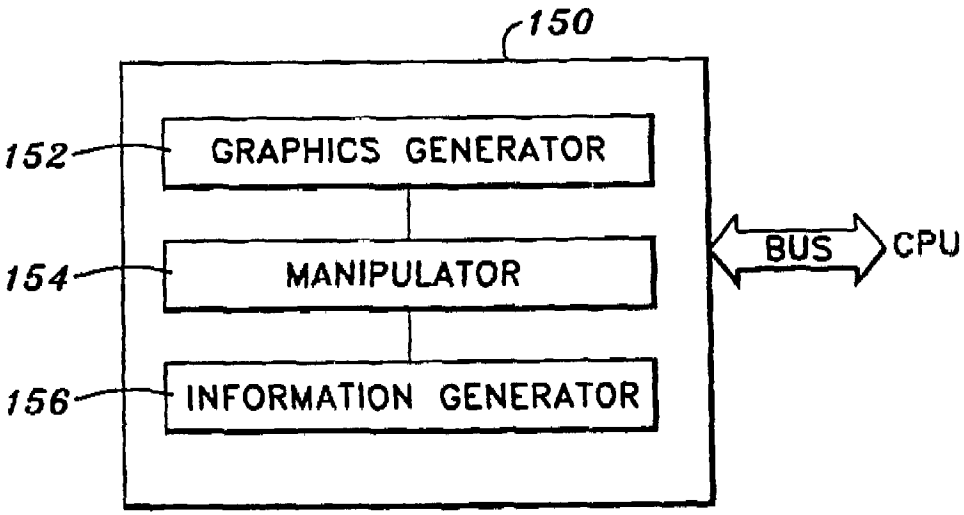
FIG. 5 illustrates a system for generating and presenting gaming environment information in accordance with an embodiment of the invention.

In one or more embodiments of the invention, and as illustrated in FIG. 5, the virtual information host 36 includes a system for generating graphical system information and displaying related information in accordance with the invention. The system 150 may be connected to the CPU 113 of the virtual information host 36 and may be implemented with software and/or hardware, as described above.

In one embodiment, the system 150 includes a gaming system graphics generator 152. The graphics generator 152 is arranged to generate the graphical representation of the gaming environment. The system 150 may also include a manipulator 154 arranged to manipulate the generated graphics information, such as move, zoom, alter or otherwise alter or change the graphical information or the information which is displayed. The system 150 also includes an information generator 156 arranged to generate and display information associated with an element of the graphical information, such as the graphical representation of a gaming system device.

Of course, the invention may be implemented in a distributed environment. For example, a number of computing devices may be coupled to a single host which is adapted to generate and provide the information. The individual computing devices may be utilized by different operators who may view the same or different information. One or more of these computing devices may be remote from the other and/or the main computer or host.

The invention has a variety of benefits and advantages. A primary advantage of the invention is that information regarding a variety of systems or functions is made centrally available, and in a manner which is easily obtainable and understandable. The complexity of the arrangement of a complete gaming environment or system which can not be physically viewed at one time can be presented to a user in a simplistic, easy to understand manner.

The user of the system can readily identify individual components and their location relative to its actual environment, including other gaming system devices, casino or the like. One advantage of this is that a user of the system may communicate informative information to other parties. For example, a user of the system may identify a problem with a particular gaming system device. The user may issue, such as by writing or printing, a service request. The service request may include information which will aid the service technician in locating the gaming system device. For example, this information may identify that the gaming system device is the end machine in the first bank of machines to the left of the rear exit at XYZ casino.

In accordance with the invention, information associated with a variety of different functions or systems is accessible from a single source or location. A user may obtain information regarding a particular player of a gaming system device from the player tracking system, and accounting information for the same machine from an accounting system, all at a single location.

Another advantage is that information regarding particular devices is associated with a visual representation of the particular device. This information presentation format may result in a number of benefits. A user may identify certain trends based upon the relative locations of gaming system devices, which trends are more readily appreciated because the locations of the gaming system devices and their associated information is displayed in a visibly identifiable format.

The information which a user may obtain may be used for a variety of purposes. For example, information regarding a particular gaming device may be used to determine that the device is not productive and should be taken out of service or moved to another location. The information may be used to learn the identity of a player and award them a bonus. The information might also be used for security purposes, including identifying a player who is cheating If certain gaming system devices are added, removed or moved, the graphical representation is updated. A user of the system thus need not guess at the particular location of a gaming system device, such as relying on old blueprints or memory as in today's systems. Instead, a casino's continually changing layout can be easily monitored and reflected in the graphical information provided to the user.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A system of configuring a graphical user interface comprising:

at least one processor;

at least one interface operable to provide a communication link to at least one other network device; and memory;

the system being operable to:

identify a gaming system, the gaming system including a plurality of physical components which actually exist in three-dimensional space, the plurality of components each having a relative position in the gaming system with respect to each other;

generate a graphical representation of a first portion of the gaming system, said graphical representation including graphical objects representing one or more of the physical components of said gaming system; and display, in a first window of the graphical user interface, a first portion of the graphical representation, wherein the first portion of the graphical representation includes one or more displayed objects representing one or more of the physical components which are located in the first portion of the gaming system;

display at least a portion of said displayed objects in positions relative to one another in a manner which substantially matches the relative positions of the corresponding physical components in the first portion of the gaming system which said displayed objects represent;

wherein the first portion of the graphical representation includes a first person object uniquely representing a first actual person located in the first portion of the gaming system; and wherein the first person object is displayed during at least one time period when the first actual person is not participating in an active gaming session at a gaming table.

2. The system of claim 1:

wherein the first portion of the graphical representation includes a second person object uniquely representing a second actual person located in the first portion of the gaming system.

3. The system of claim 1:

wherein the first portion of the graphical representation is operable to display a first displayed graphical object uniquely representing a first actual person located in the first portion of the gaming system; and wherein the first portion of the graphical representation is further operable to display a second displayed graphical object uniquely representing a second actual person located in the first portion of the gaming system.

4. The system of claim 1;

wherein the first portion of the graphical representation is operable to display a first displayed graphical object representing a first actual person located in the first portion of the gaming system;

wherein the first portion of the graphical representation is further operable to display a second displayed graphical object representing a second actual person located in the first portion of the gaming system; and wherein the actual persons include at least one of: players and dealers.

5. The system of claim 1:

wherein the first portion of the graphical representation is operable to display a first displayed graphical object representing a first actual person located in the first portion of the gaming system;

wherein the first portion of the graphical representation is further operable to display a second displayed graphical object representing a second actual person located in the first portion of the gaming system at a specified time T; and wherein the specified time T correspond to real-time or a current time.

6. The system of claim 1:

display a first displayed graphical person object in the first portion of the graphical representation which uniquely represent a first actual person located in the first portion of the gaming system;

detect movement of said first actual person in the first portion of the gaming system; and move a position of the displayed graphical person object based upon movement of said first actual person in the first portion of the gaming system;

wherein the movement of the displayed graphical person object in the first portion of the graphical representation is relative to the movement of the first actual person in the first portion of the gaming system.

7. The system of claim 1:

wherein the first portion of the graphical representation is operable to display a first displayed graphical object representing a first actual person located in the first portion of the gaming system;

wherein the first portion of the graphical representation is further operable to display a second displayed graphical object representing a second actual person located in the first portion of the gaming system at a specified time T; and wherein the specified time corresponds to a selected previous point in time.

8. The system of claim 1 wherein the displayed first portion of the graphical representation corresponds to a 3-dimensional representation of the first portion of the gaming system.

9. The system of claim 1 wherein the first portion of the graphical representation includes one or more displayed game table objects representing one or more game tables.

10. The system of claim 1 wherein the first portion of the graphical representation includes one or more displayed objects representing one or more non-electronic gaming devices.

11. The system of claim 1 being further operable to:

accept selection of a first displayed object in the first window of the graphical user interface, the first displayed object corresponding to a first physical component located in the first portion of the gaming system;

access additional information regarding the first physical component; and display at least a portion of said additional information.

12. The system of claim 1 wherein said first portion of the gaming system includes a first actual player, the system being further operable to:

accept selection of a first displayed object in the first window of the graphical user interface, the first displayed object uniquely representing the first actual player;

access additional information regarding the first actual player; and display at least a portion of said additional information, wherein said additional information includes an image of the actual player which was taken by a camera.

13. The system of claim 1 wherein said first portion of the gaming system includes a first actual dealer at a first actual game table, the system being further operable to:

accept selection of a first displayed object in the first window of the graphical user interface, the first displayed object uniquely representing the first actual dealer;

access additional information regarding the first actual dealer; and display at least a portion of said additional information, wherein said additional information includes dealer-related information selected from a group consisting of: dealer identity information, and information relating to time which the dealer has spent at the game table.

14. The system in accordance with claim 1 being further operable to:

retrieve information, from a remote location, regarding the one or more components of said gaming system represented by said selected displayed objects of said graphical user interface.

15. The system in accordance with claim 1 wherein said generating comprises collecting image information from one or more cameras.

16. The system in accordance with claim 1 being further operable to:

accept navigation input and displaying a new portion of said graphical representation.

17. The system in accordance with claim 1 wherein said gaming system includes a first actual player physically adjacent to a first actual gaming machine, the system being further operable to:

generate a first graphical representation of a player object which uniquely represents the first actual player;

generate a second graphical representation of a gaming machine abject which uniquely represents the first actual gaming machine; and display, in the first window of the graphical user interface, the gaming machine object and the player object wherein the player object is positioned adjacent to the gaming machine object.

18. The system in accordance with claim 1 wherein said gaming system includes a first actual player physically adjacent to a first actual gaming machine, the system being further operable to:

generate a first graphical representation of a player object which uniquely represents the first actual player;

generate a second graphical representation of a gaming machine object which uniquely represents the first actual gaming machine;

display, in the first window of the graphical user interface, the gaming machine object and the player object wherein the player object is positioned adjacent to the gaming machine object;

access player-related information relating the first actual player; and display at least a portion of said player-related information as being associated with the player object.

19. The system in accordance with claim 1 wherein said first portion of the gaming system includes a first actual player, the system being further operable to:

display, in the first portion of the graphical representation, a first graphical representation of a player object which uniquely represents the first actual player;

access player identity information regarding the identity of said first actual player;

display the player identity information as being associated with the player object.

20. The system in accordance with claim 1 wherein said first portion of the gaming system includes a first actual player, the system being further operable to:

display, in the first portion of the graphical representation, a first graphical representation of a player object which uniquely represents the first actual player;

access player reward information regarding a player reward account associated with said first actual player;

display the player reward information as being associated with the player object.

21. The system of claim 1 wherein said gaming system includes a first actual gaming machine, the system being further operable to:

display, in the first window of the graphical user interface a graphical representation of a gaming machine object which uniquely represents the first actual gaming machine;

receive, at a local device, input from a local user, the input including instructions for forwarding a first portion of information to the first actual gaming machine; and forward the first portion of information to the first actual gaming machine in response to the receipt of the input from the local user.

22. A system of configuring a graphical user interface comprising:

at least one processor;

at least one interface operable to provide a communication link to at least one other network device; and memory;

the system being operable to:

identify a gaming system, the gaming system including a plurality of physical components which actually exist in three-dimensional space, the plurality of components each having a relative position in the gaming system with respect to each other;

generate a graphical representation of a first portion of the gaming system, said graphical representation including graphical objects representing one or more of the physical components of said gaming system; and display, in a first window of the graphical user interface, a first portion of the graphical representation, wherein the first portion of the graphical representation includes one or more displayed objects representing one or more of the physical components which are located in the first portion of the gaming system; and display at least a portion of said displayed objects in positions relative to one another in a manner which substantially matches the relative positions of the corresponding physical components in the first portion of the gaming system which said displayed objects represent;

wherein the displayed graphical representation of the first portion of the gaming system includes real-time information relating to the first portion of the gaming system;

wherein the first portion of the graphical representation includes a first person object representing a first actual person located in the first portion of the gaming system;

wherein the first person object is displayed during at least one time period when the first actual person is not participating in an active gaming session at a gaming table.

23. The system of claim 22 being further operable to:

detect at least one change in activity relating to at least one component of the first portion of the gaming system; and update, in substantially real-time, the real-time information displayed in the graphical representation to thereby reflect the at least one change in activity relating to at least one component of the first portion of the gaming system.

24. The system of claim 22 wherein the real-time information includes information selected from a group consisting of player-related events, player input information, player statistical information, coins in events, coins out events, identification of a game currently being played at a specific gaming machine, current game play status information, gaming machine ID information, current player bonus award information, current player award points information, gaming machine manufacturer information, gaming machine operational status information wagering information, and payout information.

25. The system of claim 22 wherein the real-time information includes information relating to dealers and players who are currently present at one or more game tables within the first portion of the gaming system.

26. The system of claim 22 wherein the real-time information includes information indicating which gaming machines within the first portion of the gaming system are currently in use by a player.

27. A method of configuring a graphical user interface comprising:

identifying a gaming system, the gaming system including a plurality of physical components which actually exist in three-dimensional space, the plurality of components each having a relative position in the gaming system with respect to each other;

generating a graphical representation of a first portion of the gaming system, said graphical representation including graphical objects representing one or more of the physical components of said gaming system; and displaying, in a first window of the graphical user interface, a first portion of the graphical representation, wherein the first portion of the graphical representation includes one or more displayed objects representing one or more of the physical components which are located in the first portion of the gaming system;

displaying at least a portion of said displayed objects in positions relative to one another in a maimer which substantially matches the relative positions of the corresponding physical components in the first portion of the gaming system which said displayed objects represent;

wherein the first portion of the graphical representation includes a first person object uniquely representing a first actual person located in the first portion of the gaming system and wherein the first person object is displayed during at least one time period when the first actual person is not participating in an active gaming session at a gaming table.

28. The method of claim 27:

wherein the first portion of the graphical representation includes a second person object uniquely representing a second actual person located in the first portion of the gaming system.

29. The method of claim 27:

wherein the first portion of the graphical representation is operable to display a first displayed graphical object uniquely representing a first actual person located in the first portion of the gaming system; and wherein the first portion of the graphical representation is further operable to display a second displayed graphical object uniquely representing a second actual person located in the first portion of the gaming system.

30. The method of claim 27:

wherein the first portion of the graphical representation is operable to display a first displayed graphical object representing a first actual person located in the first portion of the gaming system;

wherein the first portion of the graphical representation is further operable to display a second displayed graphical object representing a second actual person located in the first portion of the gaming system; and wherein the actual persons include at least one of: players and dealers.

31. The method of claim 27:

wherein the first portion of the graphical representation is operable to display a first displayed graphical object representing a first actual person located in the first portion of the gaming system;

wherein the first portion of the graphical representation is further operable to display a second displayed graphical object representing a second actual person located in the first portion of the gaming system at a specified time T; and wherein the specified time T correspond to real-time or a current time.

32. The method of claim 27:

displaying a first displayed graphical person object in the first portion of the graphical representation which uniquely represent a first actual person located in the first portion of the gaming system;

detecting movement of said first actual person in the first portion of the gaming system; and moving a position of the displayed graphical person object based upon movement of said first actual person in the first portion of the gaming system;

wherein the movement of the displayed graphical person object in the first portion of the graphical representation is relative to the movement of the first actual person in the first portion of the gaming system.

33. The method of claim 27:

wherein the first portion of the graphical representation is operable to display a first displayed graphical object representing a first actual person located in the first portion of the gaming system;

wherein the first portion of the graphical representation is further operable to display a second displayed graphical object representing a second actual person located in the first portion of the gaming system at a specified time T; and wherein the specified time corresponds to a selected previous point in time.

34. The method of claim 27 wherein the displayed first portion of the graphical representation corresponds to a 3-dimensional representation of the first portion of the gaming system.

35. The method of claim 27 wherein the first portion of the graphical representation includes one or more displayed game table objects representing one or more game tables.

36. The method of claim 27 wherein the first portion of the graphical representation includes one or more displayed objects representing one or more non- electronic gaming devices.

37. The method of claim 27 further comprising:

accepting selection of a first displayed object in the first window of the graphical user interface, the first displayed object corresponding to a first physical component located in the first portion of the gaming system;

accessing additional information regarding the first physical component; and displaying at least a portion of said additional information.

38. The method of claim 27 wherein said first portion of the gaming system includes a first actual player, the method further comprising:

accepting selection of a first displayed object in the first window of the graphical user interface, the first displayed object uniquely representing the first actual player;

accessing additional information regarding the first actual player; and displaying at least a portion of said additional information, wherein said additional information includes an image of the actual player which was taken by a camera.

39. The method of claim 27 wherein said first portion of the gaming system includes a first actual dealer at a first actual game table, the method further comprising:

accepting selection of a first displayed object in the first window of the graphical user interface, the first displayed object uniquely representing the first actual dealer;

accessing additional information regarding the first actual dealer; and displaying at least a portion of said additional information wherein said additional information includes dealer-related information selected from a group consisting of: dealer identity information, and information relating to time which the dealer has spent at the game table.

40. The method in accordance with claim 27 further comprising:

retrieving information, from a remote location, regarding the one or more components of said gaming system represented by said selected displayed objects of said graphical user interface.

41. The method in accordance with claim 27 wherein said generating comprises collecting image information from one or more cameras.

42. The method in accordance with claim 27 further comprising:

accepting navigation input and displaying a new portion of said graphical representation.

43. The method in accordance with claim 27 wherein said gaming system includes a first actual player physically adjacent to a first actual gaming machine, the method further comprising:

generating a first graphical representation of a player object which uniquely represents the first actual player;

generating a second graphical representation of a gaming machine object which uniquely represents the first actual gaming machine; and displaying, in the first window of the graphical user interface, the gaming machine object and the player object, wherein the player object is positioned adjacent to the gaming machine object.

44. The method in accordance with claim 27 wherein said gaming system includes a first actual player physically adjacent to a first actual gaming machine, the method further comprising:

generating a first graphical representation of a player object which uniquely represents the first actual player;

generating a second graphical representation of a gaming machine object which uniquely represents the first actual gaming machine;

displaying, in the first window of the graphical user interface, the gaming machine object and the player object, wherein the player object is positioned adjacent to the gaming machine object;

accessing player-related information relating the first actual player; and displaying at least a portion of said player-related information as being associated with the player object.

45. The method in accordance with claim 27 wherein said first portion of the gaming system includes a first actual player, the method further comprising:

displaying, in the first portion of the graphical representation, a first graphical representation of a player object which uniquely represents the first actual player;

accessing player identity information regarding the identity of said first actual player;

displaying the player identity information as being associated with the player object.

46. The method in accordance with claim 27 wherein said first portion of the gaming system includes a first actual player, the method further comprising:

displaying, in the first portion of the graphical representation, a first graphical representation of a player object which uniquely represents the first actual player;

accessing player reward information regarding a player reward account associated with said first actual player;

displaying the player reward information as being associated with the player object.

47. The method of claim 27 wherein said gaming system includes a first actual gaming machine, the method further comprising:

displaying, in the first window of the graphical user interface a graphical representation of a gaming machine object which uniquely represents the first actual gaming machine;

receiving, at a local device, input from a local user, the input including instructions for forwarding a first portion of information to the first actual gaming machine; and forwarding the first portion of information to the first actual gaming machine in response to the receipt of the input from the local user.

48. A method of configuring a graphical user interface comprising:

identifying a gaming system, the gaming system including a plurality of physical components which actually exist in three-dimensional space, the plurality of components each having a relative position in the gaming system with respect to each other;

generating a graphical representation of a first portion of the gaming system, said graphical representation including graphical objects representing one or more of the physical components of said gaming system; and displaying, in a first window of the graphical user interface, a first portion of the graphical representation, wherein the first portion of the graphical representation includes one or more displayed objects representing one or more of the physical components which are located in the first portion of the gaming system; and displaying at least a portion of said displayed objects ha positions relative to one another in a manner which substantially matches the relative positions of the corresponding physical components lit the first portion of the gaming system which said displayed objects represent;

wherein the displayed graphical representation of the fist portion of the gaming system includes real-time information relating to the first portion of the gaming system;

wherein the first portion of the graphical representation includes a first person object representing a first actual person located in the first portion of the gaming system;

wherein the first person object is displayed during at least one time period when the first actual person is not participating in an active gaming session at a gaming table.

49. The method of claim 48 further comprising:

detecting at least one change in activity relating to at least one component of the first portion of the gaming system; and updating, in substantially real-time, the real-time information displayed in the graphical representation to thereby reflect the at least one change in activity relating to at least one component of the first portion of the gaming system.

50. The method of claim 48 wherein the real-time information includes information selected from a group consisting of: player-related events, player input information, player statistical information, coins in events, coins out events, identification of a game currently being played at a specific gaming machine, current game play status information, gaming machine ID information, current player bonus award information, current player award points information, gaming machine manufacturer information, gaming machine operational status information, wagering information, arid payout information.

51. The method of claim 48 wherein the real-time information includes information relating to dealers and players who are currently present at one or more game tables within the first portion of the gaming system.

52. The method of claim 48 wherein the real-time information includes information indicating which gaming machines within the first portion of the gaming system are currently in use by a player.

53. A system for configuring a graphical user interface comprising:

means for identifying a gaming system, the gaming system including a plurality of physical components which actually exist in three-dimensional space, the plurality of components each having a relative position in the gaming system with respect to each other;

means for generating a graphical representation of a first portion of the gaming system, said graphical representation including graphical objects representing one or more of the physical components of said gaming system; and means for displaying, in a first window of the graphical user interface, a first portion of the graphical representation, wherein the first portion of the graphical representation includes one or more displayed objects representing one or more of the physical components which are located in the first portion of the gaming system; and means for displaying at least a portion of said displayed objects in positions relative to one another in a manner which substantially matches the relative positions of the corresponding physical components in the first portion of the gaming system which, said displayed objects represent;

wherein the first portion of the graphical representation includes a first person object uniquely representing a first actual person located in the first portion of the gaming system;

wherein the first portion of the graphical representation includes a second person object uniquely representing a second actual person located in the first portion of the gaming system and wherein the first person object is displayed during at least one time period when the first actual person is not participating ii, an active gaming session at a gaming table.

54. A system for configuring a graphical user interface comprising:

means for identifying a gaming system, the gaming system including a plurality of physical components which actually exist in three-dimensional space, the plurality of components each having a relative position in the gaming system with respect to each other;

means for generating a graphical representation of a first portion of the gaming system, said graphical representation including graphical objects representing one or more of the physical components of said gaming system; and means for displaying, in a first window of the graphical user interface, a first portion of the graphical representation, wherein the first portion of the graphical representation includes one or more displayed objects representing one or more of the physical components which are located in the first portion of the gaming system; and means for displaying at least a portion of said displayed objects in positions relative to one another in a manner which substantially matches the relative positions of the corresponding physical components in the first portion of the gaming system which said displayed objects represent;

wherein the displayed graphical representation of the first portion of the gaming system includes real-time information relating to the first portion of the gaming system;

wherein the first portion of the graphical representation includes a first person object representing a first actual person located in the first portion of the gaming system;

wherein the first person object is displayed during at least one time period when the first actual person is not participating in an active gaming session at a gaming table.

* * * * *